US005596925A

United States Patent [19]

Hasegawa

[11] Patent Number: 5,596,925

[45] Date of Patent: Jan. 28, 1997

[54] METHOD AND DEVICE FOR PRESSURE TYPE STENCIL PRINTING

[75] Inventor: Takanori Hasegawa, Tokyo-to, Japan

[73] Assignee: Riso Kagaku Corporation, Tokyo-to, Japan

[21] Appl. No.: 514,983

[22] Filed: Aug. 14, 1995

Related U.S. Application Data

[63] Continuation of Ser. No. 212,833, Mar. 15, 1994, abandoned.

[30] Foreign Application Priority Data

Mar. 18, 1993 [JP] Japan ..... 5-058572

[51] Int. Cl.[6] ..... B41F 15/20

[52] U.S. Cl. ..... 101/127.1; 101/115; 101/126; 101/129

[58] Field of Search ..... 101/114–129

[56] References Cited

U.S. PATENT DOCUMENTS

| | | | |
|---|---|---|---|
| 3,172,358 | 3/1965 | Weiss | 101/126 |
| 3,221,648 | 12/1965 | Weiss | 101/129 |
| 3,372,638 | 3/1968 | Tripp | 101/114 |
| 3,418,926 | 12/1968 | Hakogi | 101/35 |
| 3,871,293 | 3/1975 | Valiela | 101/114 |
| 3,964,385 | 6/1976 | Knight | 101/128.4 |
| 4,098,184 | 7/1978 | Okada et al. | 101/41 |
| 4,519,760 | 4/1985 | Norell | 101/129 |
| 4,843,961 | 7/1989 | Smith | 101/127.1 |
| 5,050,498 | 9/1991 | Smith | 101/129 |

*Primary Examiner*—Stephen R. Funk
*Attorney, Agent, or Firm*—Dickstein Shapiro Morin & Oshinsky LLP

[57] ABSTRACT

Provided is a method and device for stencil printing which can readily achieve a stencil printing of a prescribed even density even when the surface area of the printing surface is great, and which can ensure a multi color printing to be made without mixing of colors even when a large number of copies are to be printed. Printing ink having a sufficient consistency to retain its shape is deposited on a stencil master plate S as ink lumps B, and a stencil master plate S is placed in a pressure chamber 17 with its surface carrying the ink lumps B facing the diaphragm 15, the pressure chamber 17 having a wall portion formed by a diaphragm 15 which is at least either flexible or elastic. The pressure chamber 17 is then depressurized so that the diaphragm 15 conforms to the ink lumps B and wraps itself onto the ink lumps B, and the stencil master plate S in turn comes into close contact with the printing paper P by being pressed by the diaphragm 15 to thereby achieve a stencil printing on a sheet of printing paper through pressurization of the ink lumps B on the stencil master plate S.

22 Claims, 10 Drawing Sheets

METHOD AND DEVICE FOR PRESSURE TYPE STENCIL PRINTING

This application is a continuation of U.S. patent application Ser. No. 08/212,833 filed Mar. 15, 1994, now abandoned.

TECHNICAL FIELD

The present invention relates to a stencil printing device, and in particular to a pressure type stencil printing device.

BACKGROUND OF THE INVENTION

As a well known pressure type stencil printing device, there is known the one which comprises a pressure plate having an edge hinged to a base, a printing paper supporting table made of elastic material such as a foamed elastomer and placed on the base, and a stencil master plate mounting portion provided on the surface of the pressure plate opposing the printing paper supporting table. Such a stencil printing device is disclosed, for instance in Japanese utility model laid open publication No. 62-196567.

According to such a pressure type stencil printing device, a stencil printing is made by pivotally pressing down the pressure plate by a hand so that the stencil master plate mounted on the pressure plate may be pressed onto the printing paper placed on the printing paper supporting table.

According to a known suction type textile printing device for placing a screen serving as a stencil on textile and dying the textile by depositing dye thereon in a prescribed pattern, the textile is placed on a porous support or a mesh plate having a number of holes provided therein, and with a stencil screen placed over the textile, suction is applied to the porous support or the mesh plate so that the suction is applied, via the textile on the porous support or the mesh plate, to the surface of the stencil screen facing the textile, and the dye deposited on the stencil screen is drawn into the textile through the openings of the stencil screen. Such suction type textile printing devices are disclosed, for instance, in Japanese patent publications (kokoku) Nos. 37-3944, 38-5199 and 44-13797 (U.S. Pat. No. 3,221,648).

To achieve a stencil printing at a prescribed density with a pressure type stencil printing device, a prescribed printing pressure is required, and the required pressure becomes greater as the printing surface area becomes larger.

On the other hand, according to such a stencil printing device, the printing pressure effective in pressing the stencil master plate onto the printing paper placed on the printing paper supporting table is produced by pressing down the pressure plate with a hand for pivoting the same, and is therefore quite limited in magnitude.

Also, to achieve a stencil printing of a uniform density, it is necessary to apply an even printing pressure over the entire printing surface. However, according to such a conventional stencil printing device, because the pressure plate is pivotally supported, and the rotational downward movement of the pressure plate is directly applied to the printing surface as a printing pressure, the printing pressure applied to the printing surface tends to be uneven, and there is some difficulty in obtaining stencil print images of a high level of uniformity. This tendency is particularly pronounced when the printing surface area becomes greater, and with the increase in the printing surface area, obtaining uniform stencil printed images and achieving a practical stencil printing become increasingly more difficult.

In view of such problems, the size of the printing paper for such a stencil printing device is limited to B5 (182×257 mm) and A4 (210×297 mm).

Furthermore, according to such a stencil printing device, because the pressure acts upon the printing ink deposited on the stencil master plate in the direction to pass across the stencil master plate, even though the printing ink deposited on limited regions of the stencil master plate, the printing ink deposited on the stencil master plate is laterally extended every time a printing pressure is applied to the printing ink, and the amount of wasted printing ink increases. This occurs also when multi color printing is carried by using a stencil master plate on which printing inks of various colors having the consistency or thickness sufficient to retain their shapes are individually deposited on the stencil master plate. In this case, not only a substantial amount of printing ink is wasted but also the printing inks of various colors laterally extend to such an extent as the number of printed copies increases that the printing inks of different colors may get mixed with each other, and a proper color printing with distinct colors may be made impossible.

The previously mentioned suction type textile printing device is applicable only to textile and other air-pervious materials because the suction is applied to the surface of the stencil screen facing the printing surface through a layer of material primarily consisting of the textile, and therefore cannot be applied to a stencil printing device for printing normal paper. Because, according to the suction type textile printing device, the suction transmitted to the suction holes of the porous support or the mesh of the mesh plate is applied to the surface of the stencil screen facing the printing surface via the material to be printed, and the dynamic action of the suction causes the dye deposited on the stencil screen to be drawn into the material to be printed, the suction is distributed over the stencil screen according to the pattern of the suction holes in the porous support or the mesh pattern of the mesh plate, and therefore tends to be uneven. Hence, even when the printing paper is air impervious to a certain extent, it still is not possible to obtain printed images of uniform density as opposed to the case of printing on textile.

BRIEF SUMMARY OF THE INVENTION

The present invention was made in view of such problems of the conventional pressure type stencil printing devices, and its primary object is to provide a method and device for stencil printing which can readily achieve a stencil printing of a uniform prescribed density even when the surface area of the printing surface is large.

A second object of the present invention is to provide a method and device for stencil printing which can ensure a multi color printing to be made without mixing of colors even when a large number of copies are to be printed.

A third object of the present invention is to provide a method and device for stencil printing which is provided with means for readily separating the stencil master plate from the printing surface upon completion of each printing cycle.

According to the present invention, these and objects can be accomplished by providing a method for stencil printing, comprising the steps of: preparing printing ink having a sufficient consistency to retain its shape; depositing the printing ink as ink lumps on a stencil master plate; placing the stencil master plate in a pressure chamber having a wall portion defined by a diaphragm which is at least either flexible or elastic, with a surface of the stencil master plate on which the ink lumps are deposited facing the diaphragm; and depressurizing the pressure chamber to cause the diaphragm to come into close contact with the ink lumps deposited on the stencil master plate and-the stencil master plate to come into close contact with a printing surface; whereby a stencil printing is made on the printing surface by applying a pressure onto the ink lumps deposited on the stencil master plate by way of the diaphragm.

Thus, the ink lumps deposited on the stencil master plate are hydraulically and uniformly pressed by the diaphragm according to Pascal's law so as to make a desired stencil printing on the printing surface. In other words, because the pressure applied by the diaphragm onto the stencil master plate is based on fluid pressure which is uniformly transmitted over the entire area of the diaphragm, the pressure acting upon the ink lumps may be made uniform over the entire area of the printing surface. Furthermore, because the pressure acting upon the ink lumps is perpendicular to the surface contour at every point on the surface of each of the ink lumps, the lateral expansion of the ink lumps can be avoided even after repeated application of pressure onto the ink lumps, and a multi color printing without mixing of colors can be ensured even after a large number of copies have been printed.

By restoring the pressure chamber to atmospheric pressure or introducing a positive pressure into the pressure chamber, the stencil master plate can be readily removed from the printing surface upon completion of each printing cycle.

The stencil master plate may consist of an assembly comprising a sheet which is impervious to the printing ink and adapted to be perforated to an image to be printed, a sheet of porous support material, the ink lumps being deposited on a surface of the porous support material sheet, and, preferably, an ink cover sheet which may be selectively placed over the porous support material sheet after the ink lumps are deposited on the porous support material sheet.

The objects of the present invention can be accomplished also by providing a device for stencil printing, comprising: a casing having a wall portion consisting of a diaphragm which is at least either flexible or elastic and defining a pressure chamber therein; depressurizing means for depressurizing the pressure chamber; and a printing paper supporting table placed inside the pressure chamber opposite to the diaphragm and having an elasticity. The stencil printing device of the present invention is normally provided with stencil master plate supporting means for supporting a stencil master plate in the pressure chamber between the diaphragm and the printing paper supporting table.

According to a preferred embodiment of the present invention, the stencil master plate supporting means is urged away from the printing surface by biasing means so that the stencil master plate may be readily removed away from the printing surface upon completion of each printing cycle.

Alternatively, the stencil master plate supporting means may be mounted on the diaphragm. In this case, pressurizing means may be used for pressurizing the pressure chamber for the purpose of readily removing the stencil master plate away from the printing surface upon completion of each printing cycle.

If two sides of printing paper are desired to be printed at the same time, the stencil printing device of the present invention may comprise a casing having a pair of mutually opposing wall portions each consisting of a diaphragm which is at least either flexible or elastic and defining a pressure chamber therein; depressurizing means for depressurizing the pressure chamber; and, optionally, stencil master plate supporting means for supporting a stencil master plate in the pressure chamber opposite to the diaphragms, the stencil master plate supporting means being provided for each of the diaphragms.

The stencil printing device of the present invention can even be adapted to make a stencil print not only on printing paper but also on other surfaces such as wall surfaces and external surfaces of various objects. For instance, the stencil printing device of the present invention may comprise a frame having a pair of mutually opposing openings; a diaphragm extending across one of the openings of the frame, the diaphragm being at least either flexible or elastic, and a pressure chamber being defined between the diaphragm and a printing surface by placing the other of the openings onto the printing surface; stencil master plate supporting means for supporting a stencil master plate in the pressure chamber opposite to the diaphragm; and depressurizing means for depressurizing the pressure chamber; whereby a desired stencil printing may be made by placing the printing surface over the other of the openings, and depressurizing the pressure chamber defined between the diaphragm and the printing surface with the depressurizing means with a stencil master plate supported by the stencil master plate supporting means.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
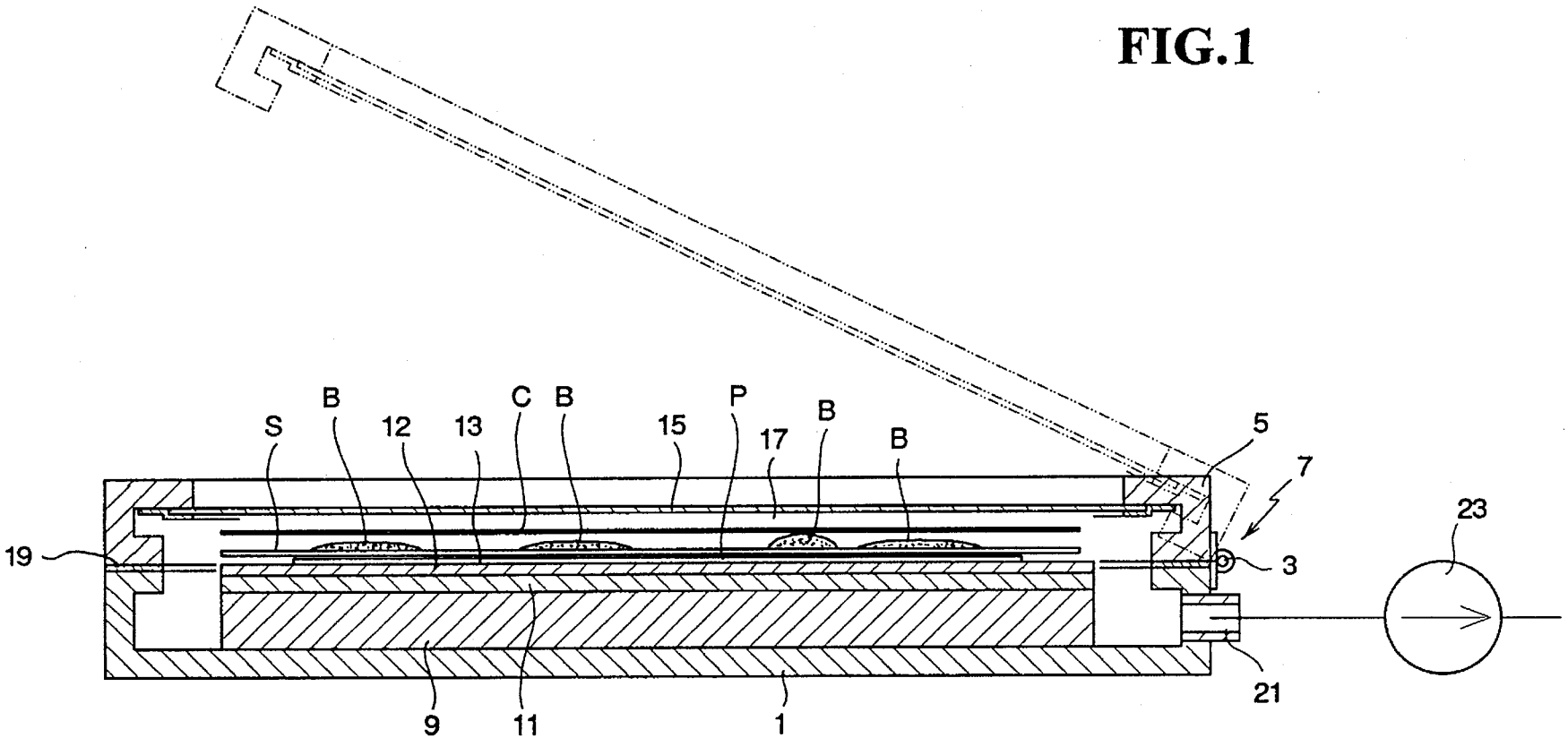
FIG. 1 is a schematic sectional view of the basic structure of a first embodiment of the stencil printing device according to the present invention at its normal pressure condition.
Figure 2:
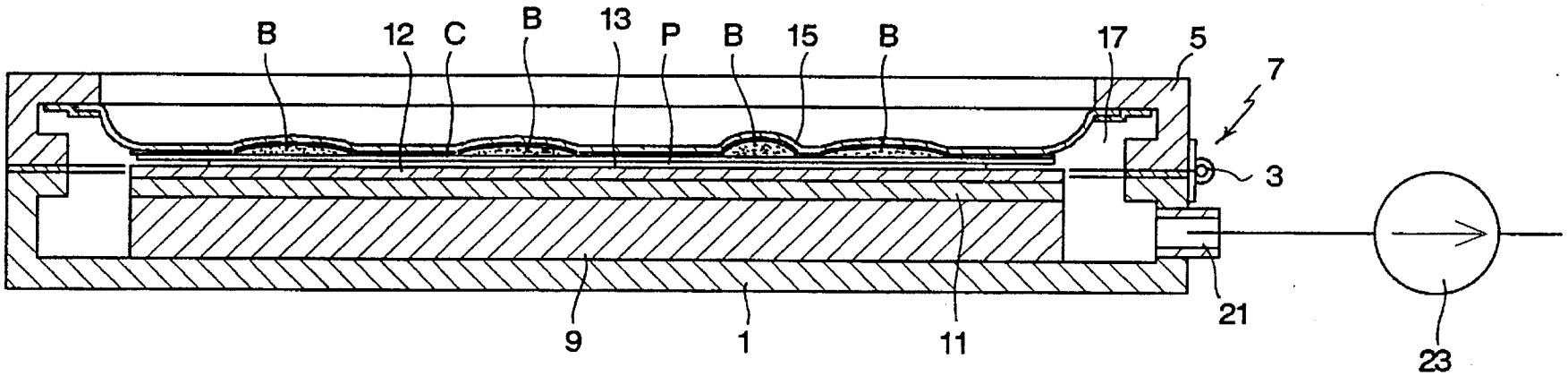
FIG. 2 is a schematic sectional view of the basic structure of the first embodiment of the stencil printing device according to the present invention at its depressurized condition.

FIGS. 1 and 2 show the basic structure of the stencil printing device according to the present invention. This stencil printing device comprises a casing 7 consisting of a casing main body 1 having an open upper end, and a lid member 5 connected to the casing main body 1 by a hinge 3 for pivotal movement.

The casing main body 1 accommodates therein a printing paper supporting table 9 in a securely fixed manner. An elastic member 11 consisting of a foamed polymer or the like is layered on the printing paper supporting table 9, and an adhesive sheet 12 consisting of silicone rubber or the like is layered on the upper surface of the elastic member 11 to removeably retain a sheet of printing paper P, the planar upper surface of the adhesive sheet 12 defining a printing paper supporting surface 13.

The adhesive sheet 12 may be identical to the one disclosed in Japanese utility model laid open (kokai) publication No. 62-15725, and for more details of the adhesive layer 12 reference should be made to this patent publication.

The lid member 5 can be pivoted between a closed position for closing the open upper end of the casing main body 1 by being placed over the casing main body 1 as indicated by the solid lines in FIG. 1, and an open position for opening up the open upper end of the casing main body 1 by being pivoted upward away from the casing main body 1 as indicated by the imaginary lines in FIG. 1.

The lid member 5 is provided with a large opening which exposes the printing paper supporting surface 13 when the lid member 5 is at its closed position, and a diaphragm 15 extends over the entire opening of the lid member 5. The diaphragm 15 consists of elastic and/or flexible film made of such materials as soft. polyvinylchloride and rubber, and opposes the printing paper supporting surface 13 with a certain gap defined therebetween.

Thus, the casing 7 internally defines a pressure chamber 17 having a wall portion formed by the diaphragm when the lid member 5 is at its closed position.

When the air-tightness of the pressure chamber 17 is required to be improved, a magnetic rubber plate 19 may be placed in the interface between the casing main body 1 and the lid member 5 so that the casing main body 1 and the lid member 5 may be joined together by the magnetic attraction of the magnetic rubber plate 19.

The casing main body 1 is provided with a port 21 communicating with the interior of the pressure chamber 17, and this port 21 is connected to a suction pump 23 for depressurizing the pressure chamber 17.

When a stencil printing is to be carried out by using the stencil printing device having the above described structure, printing ink having a consistency sufficient to retain its shape is deposited on selected regions of the stencil master plate S as ink lumps B, and with the lid member 5 placed at its open position this stencil master plate 5 is placed over the printing paper P placed on the printing paper supporting surface 13. Then, an ink cover sheet C is placed over the stencil master plate S to prevent the ink lumps B on the stencil master plate S from adhering to the diaphragm 15.

The printing ink used in this stencil printing device is required to be able to retain its shape as ink lumps B on the stencil master plate S, and preferably consists of an emulsion type printing ink having a sufficient consistency to retain its shape with a one minute spread meter reading of 32 or less as disclosed in Japanese patent publication (kokoku) No. 54-23601. The printing ink may be provided with thixotropic properties.

Figure 3:
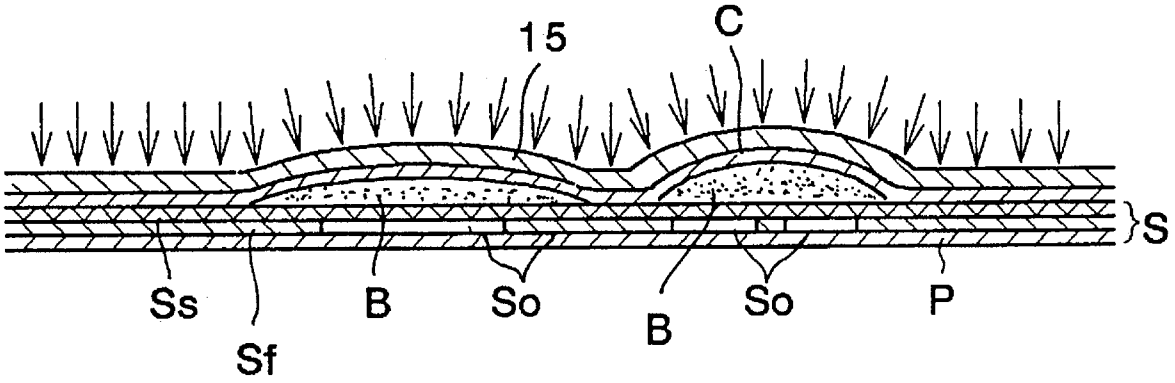
FIG. 3 is an enlarged sectional view showing the basic concept of the method for stencil printing according to the present invention.

The stencil master plate S may consist of a laminated assembly of an ink-impervious thermoplastic plastic film Sf and a sheet of porous ink-pervious support member Ss consisting of Japanese paper or fabric as illustrated in FIG. 3 so that it may serve as a heat-sensitive stencil master plate sheet. Perforations SO are formed in the thermoplastic plastic film Sf to the images to be printed, and printing ink is deposited on the surface of the porous support member Ss as ink lumps B.

Upon completion of such a preparation, the lid member 5 is closed. As a result, the stencil master plate S opposes the diaphragm 15 with its surface carrying the ink lumps B facing the diaphragm 15 inside the pressure chamber 17.

Then, the suction pump 23 is activated and air is drawn out of the pressure chamber 17 via the port 21 to depressurize the pressure chamber 17. Because the pressure chamber 17 is substantially enclosed by the diaphragm 15, the resulting negative pressure in the pressure chamber 17 acts across the two sides of the diaphragm 15 as a static pressure, and this pressure difference causes the diaphragm 15 to be drawn toward the printing paper supporting table 9 as illustrated in FIGS. 2 and 3, the diaphragm 15 is wrapped onto the ink lumps B deposited on the stencil master plate S and conforms to the shape of the ink lumps B. The stencil master plate S is thus pressed by the diaphragm 15 and comes into close contact with the printing paper P.

In this condition, the diaphragm 15 uniformly and hydraulically presses the ink lumps B deposited on the stencil master plate S according to Pascal's law or, in other words, evenly over the entire surface of the stencil master plate by virtue of the pressure difference developed across the diaphragm 15, and this pressure causes the printing ink of the ink lumps B to be transferred onto the surface of the printing paper P via the perforations SO of the stencil master plate S (refer to FIG. 3) so that a stencil printing of uniform density can be made on the printing paper P.

As schematically illustrated in FIG. 3, because the diaphragm 15 uniformly and hydraulically presses the ink lumps B deposited on the stencil master plate S according to Pascal's law, each point on the entire surface of the ink lumps B on the stencil master plate S facing the diaphragm 15 receives pressure from a direction perpendicularly to the surface contour. Therefore, the lateral expansion of the ink lumps B can be avoided, and the shapes of the ink lumps B can be maintained even when a large number of copies are printed and the pressure is repeatedly applied to the ink lumps B.

This prevents the printing ink of mutually adjacent ink lumps from mixing with each other, and, thus, even when a large number of copies are printed from a same stencil master plate, a satisfactory color printing with distinct colors can be made.

According to this stencil printing process, the printing density is determined by the time period of keeping the pressure chamber 17 in a static depressurized state and the magnitude of the prevailing negative pressure, and the printing density can be variably adjusted by changing these parameters.

According to this stencil printing, when the diaphragm is brought into contact with the ink lumps B on the stencil master plate S, and is made to conform to the surface contour of the ink lumps B, it is desired to avoid the trapping of air bubbles between the diaphragm 15 and the ink cover sheet C because the air bubbles prevent uniform pressurization of the ink lumps B. The trapping of bubbles between the diaphragm 15 and the ink cover sheet C can be achieved by optimally controlling the time history of the depressurization of the pressure chamber 17, and also by using a film having a suitable air-pervious property. The suitable air-pervious property of such a film must be sufficiently small so as not to prevent the pressure difference applied across the diaphragm from being applied in a static manner. Examples of such a film include films having minute pores, fabrics having a densely woven structure and non-woven fabrics.

Figure 4:
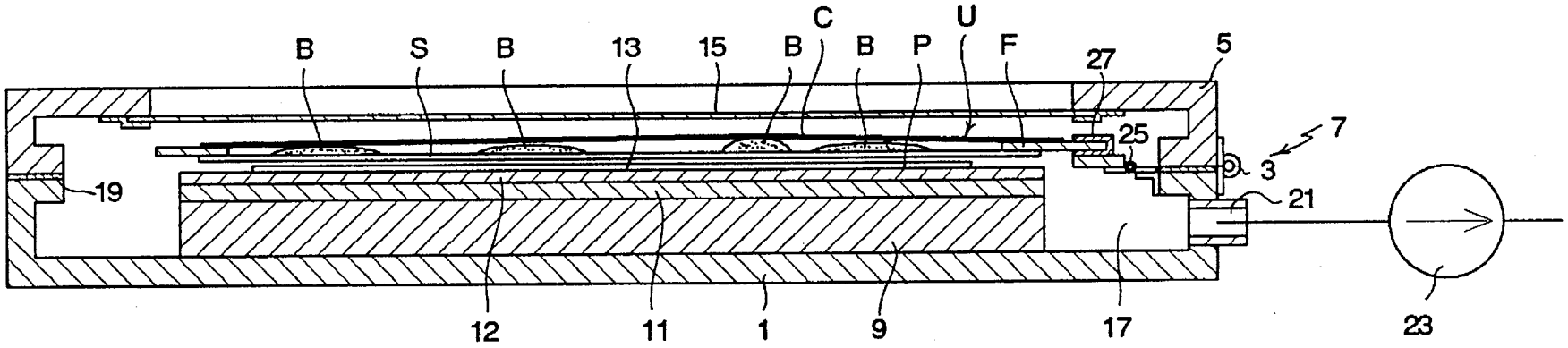
FIG. 4 is a schematic sectional view showing a second embodiment of the stencil printing device according to the present invention.

The stencil master plate S used in this stencil printing device may consist of the type in which a stencil master plate sheet is bonded to and supported by a frame F consisting of cardboard, plastic or the like and an ink cover sheet C is hinged to the frame F as illustrated in FIG. 4. In this case, the stencil master plate unit U consisting of the stencil master plate sheet S, the frame F and the ink cover sheet C may be exchangeably mounted on a stencil master plate support member 27 rotatably mounted on the casing main body 1 via a hinge 25 so as to be positioned between the diaphragm 15 and the printing paper supporting surface 13.

The stencil master plate unit U may have an identical structure as that disclosed in Japanese utility model publication (kokai) No. 51-132007, and for more details of the stencil master plate unit U reference should be made to this utility model publication.

In the embodiment illustrated in FIG. 4, ink lumps B are deposited on appropriate places on the surface of the stencil master plate S after opening up the ink cover sheet C, and after closing the ink cover sheet C, the stencil master plate unit U is mounted on the master sheet supporting member 27, and placed over the printing paper P supported by the printing paper supporting surface 13. The lid member 5 is then closed, and the pressure chamber 17 is depressurized with the suction pump 23 in the same way as in the previous embodiment.

Thus, in a similar fashion as in the previous embodiment, the diaphragm 15 is wrapped onto the ink lumps B deposited on the stencil master plate S and conforms to the shape of the ink lumps B. The stencil master plate S is thus pressed by the diaphragm 15 and comes into close contact with the printing paper P. In this condition, the diaphragm 15 uniformly and hydraulically presses the ink lumps B deposited on the stencil master plate S according to Pascal's law or, in other words, evenly over the entire surface of the stencil master plate S by virtue of the pressure difference developed across the diaphragm 15, and this pressure causes the printing ink of the ink lumps B to be transferred onto the surface of the printing paper P via the perforations SO of the stencil master plate S (refer to FIG. 3) so that a stencil printing of uniform density can be made on the printing paper P.

Upon completion of this printing process, the negative pressure of the pressure chamber 17 is released, and the pressure chamber 17 is restored to the atmospheric pressure. The lid member 5 is opened, and the stencil master plate unit U is rotated upward around the hinge 25 of the master plate supporting member 27.

Because the printing paper P on the printing paper supporting surface 13 is retained by the adhesive sheet 12, it is separated from the stencil master plate S of the stencil master plate unit U and remains on the printing paper supporting surface 13 even when the stencil master plate unit U is lifted away from the printing paper supporting surface 13. This printing paper P is thereafter removed from the adhesive sheet 12 defining the printing paper supporting surface 13.

The master plate supporting member 27 may also be functionally connected to the lid member 5 in such a manner that the master plate supporting member 27 is rotated upward with the rotation of the lid member 5 in the opening direction.

Figure 5:
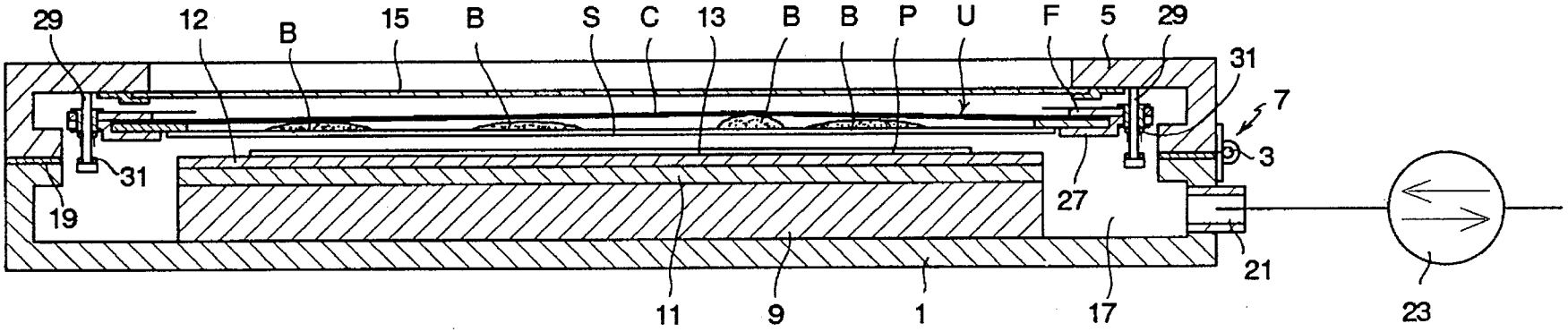
FIG. 5 is a schematic sectional view showing a third embodiment of the stencil printing device according to the present invention.

FIG. 5 shows another embodiment of the stencil printing device according to the present invention. In FIG. 5, the parts corresponding to those shown in FIGS. 1 through 4 are denoted with like numerals. In this embodiment, the master plate supporting member 27 is suspended from the inner surface of the lid member 5 with guide bars 29 in a vertically moveable manner so that the stencil master plate unit U is properly positioned between the diaphragm 15 and the printing paper supporting surface 13 when the lid member 5 is closed.

A compression coil spring 31 is interposed between a head portion provided at the lower end of each of the guide bars 29 and the master plate supporting member 27 so that the master plate supporting member 27 is urged away from the printing paper supporting surface 13 by the compression coil springs 31.

In this embodiment, when the pressure chamber 17 is depressurized, the static pressure difference developing across the diaphragm 15 causes the diaphragm 15 to be deformed and made to conform to the ink lumps B on the stencil master plate S by closely wrapping itself upon the ink lumps B, and causes the stencil master plate unit U along with the master plate supporting member 27 to be lowered toward the printing paper supporting surface 13, against the spring force of the compression coil springs 31, until it is brought into close contact with the printing paper P supported on the printing paper supporting surface 13.

In this embodiment, the diaphragm 15 is evenly pressed upon the ink lumps B on the stencil master plate S by virtue of the pressure difference developed across the diaphragm 15 in a manner similar to the previous embodiments, and a stencil printing of uniform density can be made on the printing paper P.

Upon completion of the stencil printing, the negative pressure in the pressure chamber 17 is released, and the pressure chamber 17 is restored to the atmospheric pressure. As a result, the stencil master plate unit U along with the master plate supporting member 27 is lifted to its original position by the spring force of the compression coil springs 31, and the stencil master plate S in the stencil master plate unit U is automatically separated from the printing paper P retained on the printing paper supporting surface 13 by the adhesive sheet 12.

If the stencil master plate S remains attached to the printing paper P due to adhesive force of the printing ink and the spring force of the compression coil springs 31 is not sufficient to lift the stencil master plate unit U along with the master plate supporting member 27, the suction pump 23 may be reversed so that it may be used as a pressurizing pump for applying the dynamic pressure of the pressurizing air introduced into the pressure chamber 17 to the master plate supporting member 27 so as to lift the stencil master plate unit U along with the master plate supporting member 27.

Figure 6:
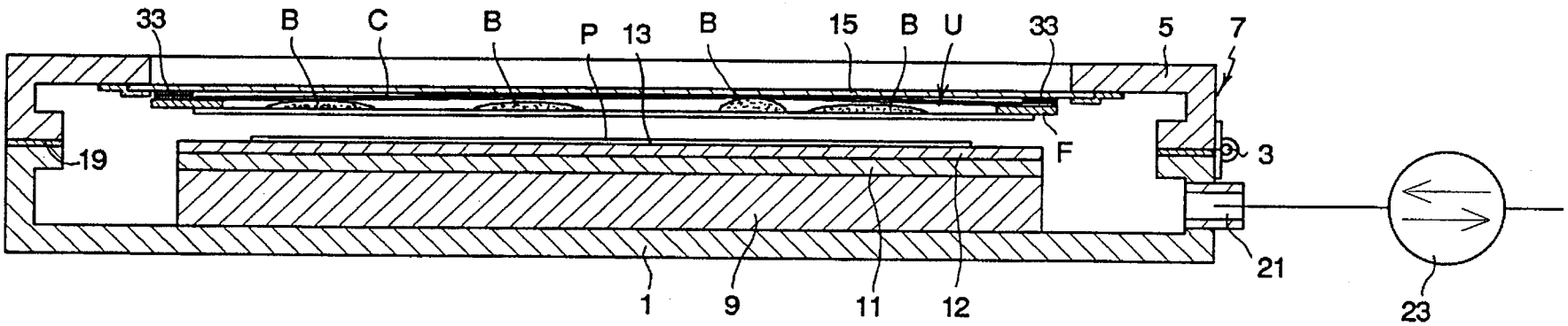
FIG. 6 is a schematic sectional view showing a fourth embodiment of the stencil printing device according to the present invention.

FIG. 6 shows another embodiment of the stencil printing device according to the present invention. In FIG. 6, the parts corresponding to those shown in FIGS. 1 through 4 are denoted with like numerals. In this embodiment, master stencil plate supporting means and a fastener tape 33 are mounted on the surface of the diaphragm 15 facing the pressure chamber 17 so that the stencil master plate unit U may be detachably mounted on the diaphragm 15.

In this embodiment, when the pressure chamber 17 is depressurized with the stencil master plate unit U mounted on the diaphragm 15 retained by the fastener tape 33, the static pressure difference developing across the diaphragm causes the diaphragm 15 along with the stencil master plate unit U to flex toward the printing paper supporting surface 13 so that the stencil master plate S of the stencil master plate unit U is pressed onto the printing paper P supported on the printing paper supporting surface 13, and the diaphragm 15 is deformed and made to conform to the ink lumps B on the stencil master plate S by closely wrapping itself upon the ink lumps B.

Thus, with the diaphragm 15 evenly pressing upon the ink lumps B on the stencil master plate S by virtue of the pressure difference developing across the diaphragm 15 in a manner similar to the previous embodiments, a stencil printing of uniform density can be made on the printing paper P.

When the negative pressure of the pressure chamber 17 is released upon completion of the stencil printing, and the pressure chamber 17 is restored to the atmospheric pressure, the diaphragm 15 regains its shape, and the stencil master plate unit U along with the diaphragm 15 returns to its original position with the result that the stencil master plate S of the stencil master plate unit U is automatically separated from the printing paper P retained by the adhesive sheet 12.

In this case, if the stencil master plate S remains attached to the printing paper and the diaphragm 15 would not return to its original position due to adhesive force of the printing ink, the suction pump 23 may be reversed so that it may be used as a pressurizing pump for applying the dynamic pressure of the pressurizing air introduced into the pressure chamber 17 to the master plate supporting member 27 to lift the stencil master plate unit U along with the master plate supporting member 27 away from the printing paper P on the printing paper supporting surface 13.

Figure 7:
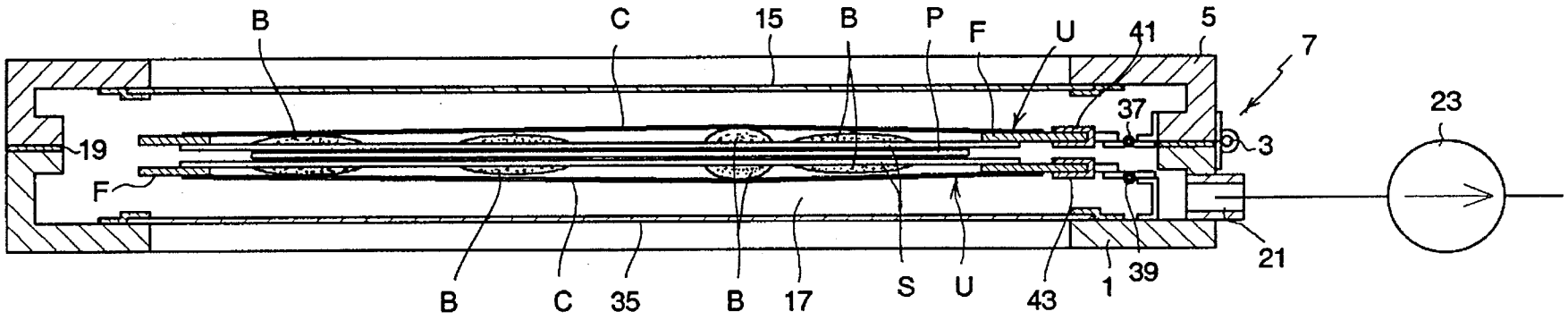
FIG. 7 is a schematic sectional view showing a fifth embodiment of the stencil printing device according to the present invention.

FIG. 7 shows yet another embodiment of the stencil printing device according to the present invention. In FIG. 7, the parts corresponding to those shown in FIGS. 1 through 4 are denoted with like numerals. In this embodiment, the casing main body 1 does not contain the printing paper supporting table 9, the elastic member 11 or the adhesive sheet 12 therein, and the bottom of the casing main body 1 is provided with a large opening which is closed by another diaphragm 35 similar to the diaphragm 15 similarly consisting of an elastic and/or flexible thin film made of soft polyvinylchloride, rubber or the like, the diaphragm 35 opposing the diaphragm 15 with a certain distance provided therebetween.

A pair of master plate supporting members 41 and 43 are rotatably mounted on the casing main body 1 and the lid member 5, respectively, by way of hinges 37 and 39, respectively, and the master plate supporting members 41 and 43 detachably support stencil master plate units U at positions opposing the corresponding diaphragms 15 and 35, respectively.

In this embodiment, the stencil master plate units U are mounted on the associated master plate supporting members 41 and 43, and after a sheet of printing paper P is placed between the support stencil master plate units U the pressure chamber 17 is depressurized.

When the pressure chamber 17 is depressurized, the diaphragms 15 and 35 are drawn toward each other by the pressure difference acting across each of the diaphragms 15 and 35 as a static pressure, and the diaphragm 15 is deformed and made to conform to the ink lumps B on the stencil master plate S on the side of the master plate supporting member 41 by closely wrapping itself upon the ink lumps B while the diaphragm 35 is deformed and made to conform to the ink lumps B on the stencil master plate S on the side of the master plate supporting member 43 by closely wrapping itself upon the ink lumps B. With the diaphragms 15 and 35 evenly pressing upon the ink lumps B on the stencil master plate units U by virtue of the pressure difference developing across each of the diaphragms 15 and 35, the stencil master plate S on the side of the master plate supporting member 41 is brought into close contact with the upper surface of the printing paper P while the stencil master plate S on the side of the master plate supporting member 43 is brought into close contact with the lower surface of the printing paper P with the net result of interposing the printing paper P between the two stencil master plates S.

In this condition, the diaphragms 15 and 35 each uniformly and hydraulically press the ink lumps B deposited on the stencil master plates S according to Pascal's law or, in other words, evenly over the entire surfaces of the stencil master plates by virtue of the pressure difference developed across the diaphragm 15, and this pressure causes the printing ink of the ink lumps B to be transferred onto the upper and lower surfaces of the printing paper P via the perforations SO of the stencil master plates S (refer to FIG. 3) so that a stencil printing of uniform density can be made on each side of the printing paper P. In this case, the diaphragms 15 and 35 each serve as a printing paper supporting table having an elastic property owing to air pressure.

In the stencil printing device of this embodiment, it is also possible to mount a stencil master plate unit U only on the master plate supporting member 41, and place a sheet of printing paper P on the diaphragm 35 so that only one side of the printing paper may be printed.

Figure 8:
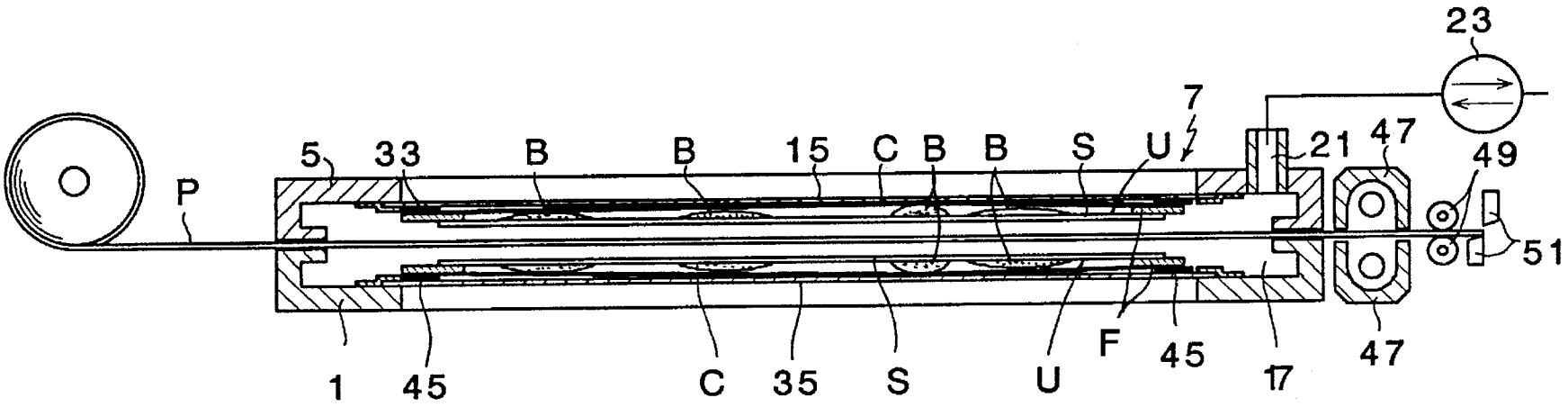
FIG. 8 is a schematic sectional view showing a sixth embodiment of the stencil printing device according to the present invention.

In the embodiment illustrated in FIG. 8, a stencil master plate unit U is detachably mounted on each of the diaphragms 15 and 35 by using fastener tapes 33 and 45, and a continuous sheet of printing paper P is passed between the two stencil master plate units U.

A heating drying device 47, paper feed rollers 49 and a paper cutter 51 are provided in that order outside the casing 7.

In this embodiment, a stencil printing is made on each of the two sides of the printing paper P in the same manner as the previous embodiment, and by feeding the printing paper P with the paper feed rollers 49 to the right as seen in the drawing, the printing ink deposited on the two sides of the printing paper to the images to be printed is dried by the heating drying device 47, and the printing paper P is cut into a prescribed length so that a two-sided printing can be carried out by automatically feeding the printing paper P.

Figure 9:
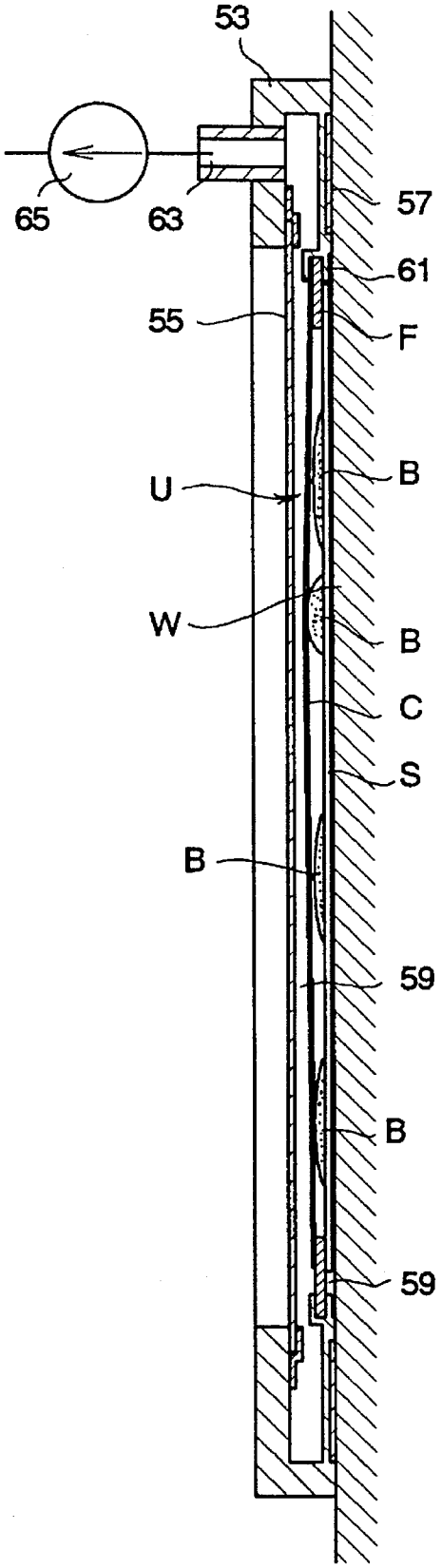
FIG. 9 is a schematic sectional view showing a seventh embodiment of the stencil printing device according to the present invention.

FIG. 9 shows yet another embodiment of the stencil printing device according to the present invention. In FIG. 9, the parts corresponding to those shown in FIGS. 1 through 4 are denoted with like numerals. In this embodiment, a diaphragm 55 having at least flexibility or elasticity is extended across a frame 53, and the frame 53 defines a part of a pressure chamber 59 by cooperating with the surface to be printed W consisting of a wall surface or the like while the diaphragm 55 defines a surface opposing the surface to be printed W when a flange surface portion 57 of the frame 53 is pressed upon a surface to be printed W.

The frame 53 is provided with a master plate supporting portion 61 for detachably supporting a stencil master plate unit U at a position opposing the diaphragm 55. Even when a stencil master plate unit U is mounted on the master plate supporting portion 61, the space defined between the stencil master plate unit U and the surface to be printed W remains communicated with the pressure chamber 59.

The frame 53 is provided with a port 63 communicating with the pressure chamber, and the port 63 is connected to a suction pump 65 for depressurizing the pressure chamber 59.

In this-embodiment, when the flange surface portion 57 of the frame 53 is pressed onto a surface to be printed W consisting of a wall surface or the like with a stencil master plate unit U mounted on the master plate supporting portion 61 so that the pressure chamber 59 may be defined between the frame 53 and the surface to be printed W.

When the pressure chamber 59 is depressurized by the suction pump 65 in this condition, the diaphragm 55 is deformed and made to conform to the ink lumps B on the stencil master plate S by closely wrapping itself upon the ink lumps B, and the stencil master plate S is closely brought into contact with the surface to be printed W.

The diaphragm 55 presses uniformly upon the ink lumps B on the stencil master plate S by virtue of the pressure difference acting across the diaphragm 55 as a static pressure in the same way as in the previous embodiments, and a stencil printing of a uniform density can be made on the surface to be printed W.

Figure 10:
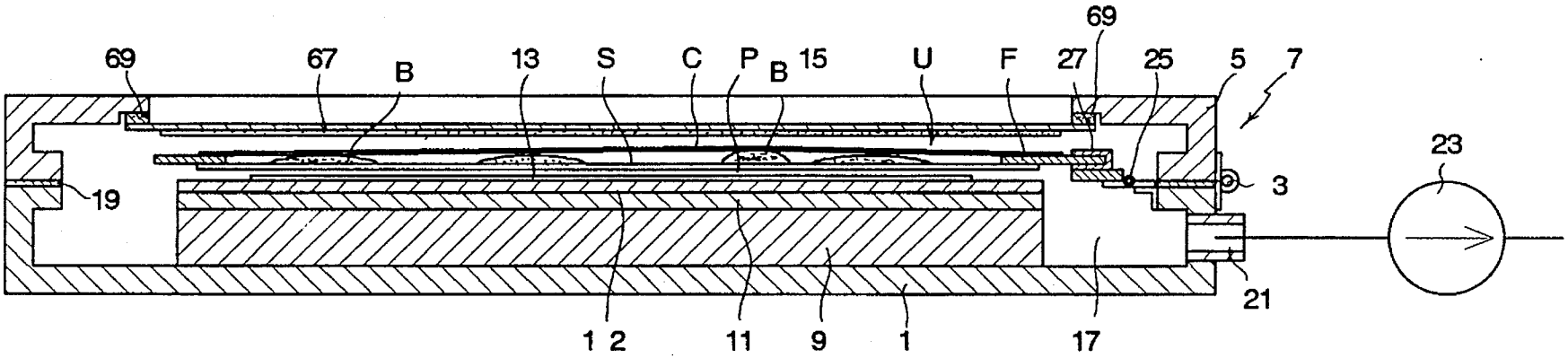
FIG. 10 is a schematic sectional view showing an eighth embodiment of the stencil printing device according to the present invention.

The surfaces of the diaphragms 15, 35 and 55 facing the stencil master plate S each may carry a foamed sheet 67 having continuous pores or a highly air-pervious property as illustrated in FIG. 10 with respect to the diaphragm 15.

The diaphragms 15, 35 and 55 may be connected to the lid member 5 via an elastic foamed member 69 as illustrated in FIG. 10 with respect to the diaphragm 15 for the purpose of reducing the stress in the part connecting these two members and avoid creating wrinkles in this part.

In the above embodiments, an ink cover sheet C was interposed between the ink lumps B on the stencil master plate sheet S and the diaphragm 15, 35 or 55, and the diaphragm 15, 35 or 55 was brought into close contact with the ink lumps B on the stencil master plate S with the ink cover sheet C intervened therebetween. Therefore, the ink cover sheet C is also desired to be consisting of a flexible and/or elastic sheet in the same manner as the diaphragms 15, 35 and 55. If the diaphragms 15, 35 and 55 may be for one-time use only, and may be discarded with printing ink attached therefore, the ink cover sheet C may be omitted.

As can be understood from the above description, according to the method and device for stencil printing of the present invention, printing ink having a sufficient consistency to retain its shape is deposited on a stencil master plate as ink lumps, and the pressure chamber is depressurized with the result that, by virtue of the pressure difference developing across the diaphragm as a static pressure, the diaphragm conforms to the ink lumps B and wraps itself onto the ink lumps B while the stencil master plate, pressed by the diaphragm, in turn comes into close contact with the surface to be printed. In this condition, the diaphragm hydraulically and uniformly presses upon each point of the surface contour of the ink lumps B deposited on the stencil master plate S according to Pascal's law from a perpendicular direction whereby a stencil printing is made on the surface to be printed. Therefore, even when the size of the surface area to be printed is large, a stencil printing of uniform prescribed density can be readily carried out. Even when pressure is applied to the ink lumps repeatedly, the ink lumps can retain their shape, and a satisfactory multi color printing can be carried out with distinct colors even when a large number of copies are printed.

When the pressure chamber is either restored to the atmospheric pressure or pressurized upon completion of each printing process, the stencil master plate can be separated from the surface to be printed, and the separation of the stencil master plate and the surface to be printed can be favorably accomplished even when the size of the surface area to the printed is large.

Although the present invention has been described in terms of specific embodiments thereof, it is possible to modify and alter details thereof without departing from the spirit of the present invention.

What we claim is:

1. A method for stencil printing, comprising the steps of:

preparing printing ink having a sufficient consistency to retain its shape;

depositing said printing ink as ink lumps on a stencil master plate;

placing said stencil master plate in a pressure chamber having a wall portion defined by a diaphragm which is at least either flexible or elastic, with a surface of said stencil master plate on which said ink lumps are deposited facing said diaphragm; and depressurizing said pressure chamber to cause said diaphragm to come into close contact with said ink lumps deposited on said stencil master plate and said stencil master plate to come into close contact with a printing surface;

whereby a stencil printing is made on said printing surface by applying a pressure onto said ink lumps deposited on said stencil master plate by way of said diaphragm.

2. A method for stencil printing according to claim 1, further comprising the step of removing said stencil master plate from said printing surface upon completion of said stencil printing by restoring said pressure chamber to atmospheric pressure or introducing a positive pressure into said pressure chamber.

3. A method for stencil printing according to claim 1, wherein said stencil master plate comprises an assembly comprising a sheet which is impervious to said printing ink and adapted to be perforated to an image to be printed, and a sheet of porous support material, said ink lumps being deposited on a surface of said support material sheet.

4. A method for stencil printing according to claim 3, wherein said assembly further comprises an ink cover sheet which may be selectively placed over said porous support material sheet after said ink lumps are deposited on said porous support material sheet.

5. A device for stencil printing, comprising:

a casing having a wall portion including a diaphragm which is at least either flexible or elastic and defining a pressure chamber therein;

a stencil master plate to be deposited with printing ink as ink lumps thereon, wherein said printing ink has a sufficient consistency to retain its shape;

a pressure controller for controlling the pressure in said pressure chamber;

a printing paper supporting table placed inside said pressure chamber opposite to said diaphragm; and wherein said pressure controller is used to depressurize said chamber.

6. A device for stencil printing according to claim 5, further comprising stencil master plate supporting means for supporting said stencil master plate in said pressure chamber between said diaphragm and said printing paper supporting table.

7. A device for stencil printing according to claim 6, wherein said stencil master plate supporting means is urged away from a printing surface by biasing means.

8. A device for stencil printing according to claim 6, wherein said stencil master plate supporting means is mounted on said diaphragm by fastening means.

9. A device for stencil printing according to claim 5, wherein said pressure controller includes means to pressurize said pressure chamber.

10. A device for stencil printing, comprising:

a casing having a pair of mutually opposing wall portions each consisting of a diaphragm which is at least either flexible or elastic and defining a pressure chamber therein;

a stencil master plate to be deposited with printing ink as ink lumps thereon, wherein said printing ink has a sufficient consistency to retain its shape;

a pressure controller for controlling the pressure in said pressure chamber;

stencil master plate supporting means for supporting said stencil master plate in said pressure chamber opposite to said diaphragms; and wherein said pressure controller is used to depressurize said chamber.

11. A device for stencil printing according to claim 10, wherein said pressure controller includes means to pressurize said pressure chamber.

12. A device for stencil printing according to claim 10, further comprising a second stencil master plate to be deposited with ink lumps;

wherein said stencil master plate supporting means is provided for each of said stencil master plates so that two sides of printing paper can be simultaneously stencil printed by being placed between said two stencil master plate supporting means.

13. A method for stencil printing, comprising the steps of:

depositing printing ink as ink lumps on a stencil master plate;

placing said stencil master plate in a pressure chamber having a wall portion defined by a diaphragm which is at least either flexible or elastic, with a surface of said stencil master plate on which said ink lumps are deposited facing said diaphragm; and depressurizing said pressure chamber to cause said diaphragm to come into close contact with said ink lumps deposited on said stencil master plate and said stencil master plate to come into close contact with a printing surface;

whereby a stencil printing is made on said printing surface by applying a pressure onto said ink lumps deposited on said stencil master plate by way of said diaphragm.

14. A device for stencil printing, comprising:

a frame having a pair of mutually opposing openings;

a diaphragm extending across one of said openings of said frame, said diaphragm being at least either flexible or elastic, and a pressure chamber being defined between said diaphragm and a printing surface by placing the other of said openings onto said printing surface;

a stencil master plate to be deposited with printing ink as ink lumps thereon, wherein said printing ink has a sufficient consistency to retain its shape;

stencil master plate supporting means for supporting said stencil master plate in said pressure chamber opposite to said diaphragm; and a pressure controller for controlling the pressure in said pressure chamber;

whereby a desired stencil printing may be made by placing said printing surface over the other of said openings, and depressurizing said pressure chamber with said pressure controller.

15. A device for stencil printing, comprising:

a casing having a wall portion including a diaphragm which is at least either flexible or elastic and defining a pressure chamber therein;

a stencil master plate for receiving lumps of printing ink thereon; and a pressure controller for controlling the pressure in said pressure chamber which causes, by depressurizing said chamber, said diaphragm to apply pressure to lumps of printing ink deposited on said stencil master plate during use, to force said ink through said master plate.

16. A device for stencil printing according to claim 15, further comprising a printing paper supporting table placed inside said pressure chamber opposite to said diaphragm.

17. A device for stencil printing according to claim 16, further comprising stencil master plate supporting means for supporting said stencil master plate in said pressure chamber between said diaphragm and said printing paper supporting table.

18. A device for stencil printing according to claim 17, wherein said stencil master plate supporting means is urged away from a printing surface by biasing means.

19. A device for stencil printing according to claim 17, wherein said stencil master plate supporting means is mounted on said diaphragm by fastening means.

20. A device for stencil printing according to claim 15, wherein said pressure controller includes means to pressurize said pressure chamber.

21. A device for stencil printing according to claim 15, further comprising lumps of printing ink.

22. A device for stencil printing according to claim 15, wherein said stencil master plate is parallel to said diaphragm.

* * * * *